United States Patent [19]

Freilev

[11] 4,187,640

[45] Feb. 12, 1980

[54] COMPLETE DOOR SET

[76] Inventor: Erik Freilev, Blaakildevej 12, DK-5634Sandager, Denmark

[21] Appl. No.: 876,516

[22] Filed: Feb. 9, 1978

[30] Foreign Application Priority Data

Feb. 18, 1977 [DK] Denmark ..... 693/77

[51] Int. Cl.[2] ..... E06B 1/00; E05D 7/02

[52] U.S. Cl. ..... 49/380; 49/382; 403/231

[58] Field of Search ..... 49/380, 382, 504; 52/211, 656; 206/325; 403/231

[56] References Cited

U.S. PATENT DOCUMENTS

| | | | |
|---|---|---|---|
| 2,826,791 | 3/1958 | Clement | 403/231 |
| 3,226,775 | 1/1966 | Workmon | 49/380 X |
| 3,295,258 | 1/1967 | Gridaine | 49/382 |
| 3,593,458 | 7/1971 | Wahlfeld et al. | 49/380 |

FOREIGN PATENT DOCUMENTS

| | | | |
|---|---|---|---|
| 880774 | 9/1971 | Canada | 403/231 |
| 2015201 | 10/1970 | Fed. Rep. of Germany | 403/231 |
| 22369 | 4/1948 | Finland | 49/380 |

*Primary Examiner*—Philip C. Kannan
*Attorney, Agent, or Firm*—Burgess, Ryan and Wayne

[57] ABSTRACT

A door set complete with side jambs, head, and a sill, by means of which the door can be assembled to be either a left-hinged door or a right-hinged door by the use of insertion hinges and a reversible lock, and where the frame joints are dowel joints. The door set makes it possible to assemble, with a minimum number of standard parts, both left-hinged doors and right-hinged doors as well as doors with or without a sill.

1 Claim, 6 Drawing Figures

COMPLETE DOOR SET

Figure 1:
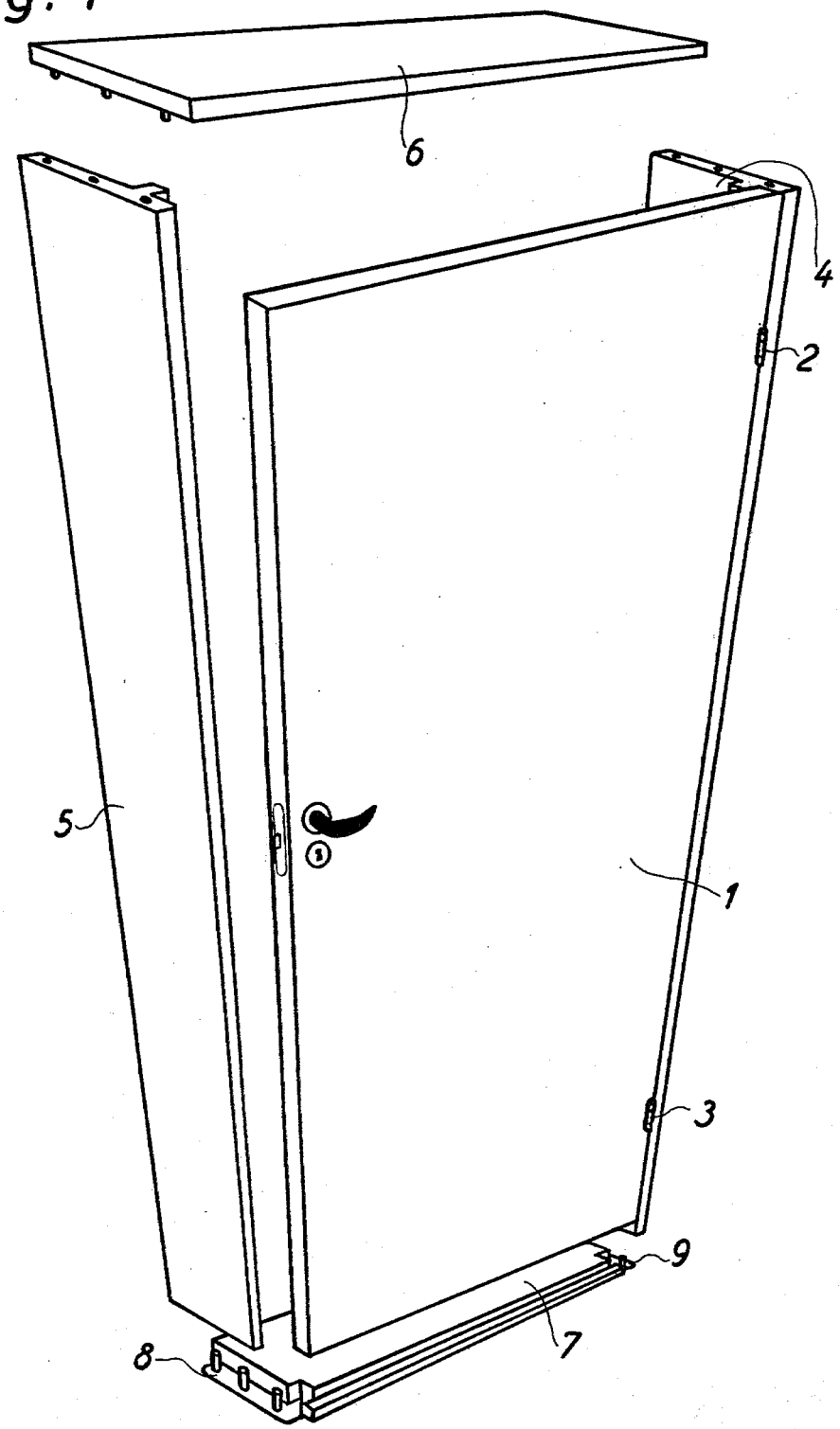

This invention relates to a door set for providing a left-hinged or right-hinged door, with or without a sill, as desired.

Another door set of the described type is already known, in which the side jambs are supplied with inserted dowels and where the corresponding dowel holes are drilled partly in the head and partly in the sill. If no sill is used, it will be necessary to insert a base part or an extension member at the foot of each side jamb. The disadvantage of such an extension member is that partly it is bad-looking and partly it is difficult to mount.

By using a complete door set of the special design herein described, the above-mentioned disadvantage can be eliminated, and moreover, it will be possible by a simple procedure to adjust the door to make up for an oblique or sloping floor by sawing off an appropriate piece of the end of one of the side jambs, in cases where no sill is used. In such cases, the drilled dowel holes at the bottom of the side jambs will not show. If, in the embodiment of this invention, the hinges on the side jamb are placed symmetrically, i.e. at the same distance from the ends, the clearance at the top and bottom will be of an equal size, irrespective of whether the door set has been assembled to be a left-hinged door or a right-hinged door.

As herein described there is provided a door set complete with side jambs and head and possibly a sill, whereby the door can be assembled as a left-hinged door or a right-hinged door by the use of so-called insertion hinges and a reversible lock, and where the distances are defined on the side jamb provided with hinges, so that $a_1$ = the distance from the middle of one hinge to one end of the side jamb, $a_2$ = the distance from the middle of the other hinge to the other end of the side jamb, $b_1$ = the distance between the middle of one hinge and the middle of the other hinge, and where the distances at the hinge side of the door and at the sill by assembling the door as a left-hinged door are defined by:

c = the clearance between the head and the top of the door, d = the distance between the top of the door and the middle of the upper hinge, $b_2$ = the distance between the middle of one hinge and the middle of the other hinge, e = the distance between the middle of the lower hinge and the bottom of the door, f = the clearance between the bottom of the door and the top of the sill, g = the height of the sill, with $g \geqq O$, as $b_1 = b_2$, $e < a_1$, $d < a_2$, $a_1$ is more or less equal to $a_2$, and where the frame joints are dowel joints, characterized in that the side jambs are provided with dowel holes at the ends, similarly designed, and in that the following requirements have been complied with:

$$a_1 = e + f + g - p$$

$$a_2 = c + d,$$

as p = the height of a horizontal supporting plate, which can be inserted at the connection of each lower corner, and which supports and connects the side jamb and the sill, the plate being provided with projecting dowels which are fitted into corresponding holes in these parts, and where p is also indicating the height of a recess in the sill, measured from the base line of the sill.

Further, there is provided a reversible door set assembly comprising a door member, two side jamb members, a head member, insertion hinge means connecting said door member and said side jamb members to permit said door set to be changed from a left-hinged door to a right-hinged door without remounting said hinge means, reversible lock means mounted on said door member and said side jamb members to permit said door set to be changed from a left-hinged door to a right-hinged door without remounting said hinge means, dowel joint means for joining said side jamb members to said head member, said dowel joint means comprising a plurality of plate elements each having a plurality of projecting dowels, dowel holes in said head member and door jambs corresponding to said projecting dowels for receiving said dowels, and a recess in said head member to receive said plate element.

The invention will be further described as follows with reference to the accompanying drawings in which:

FIG. 1 shows a door set complete with frames according to this invention, shown in perspective with some of the parts exploded.

Figure 5:
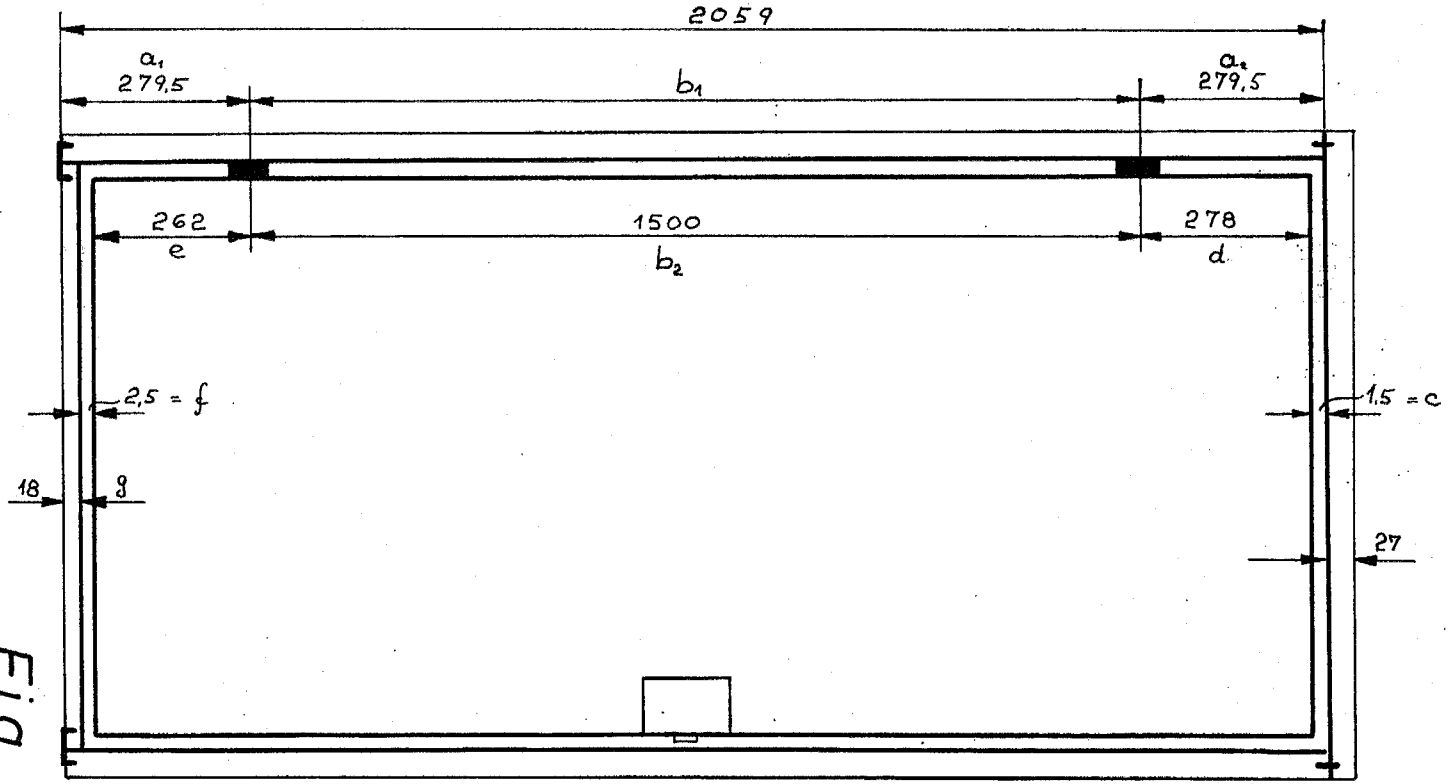
Figure 2:
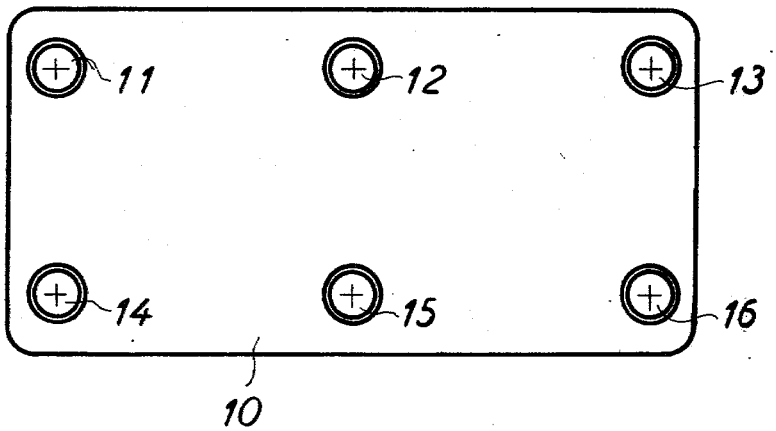
Figure 3:
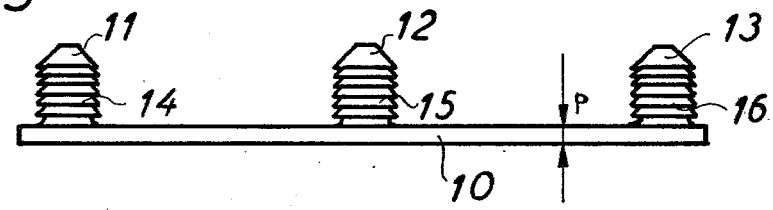
Figure 4:
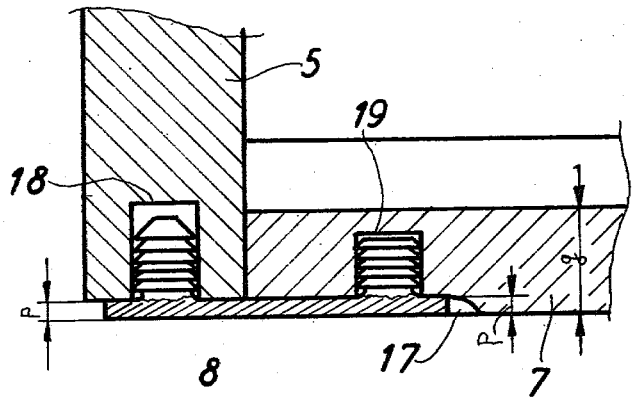
Figure 6:
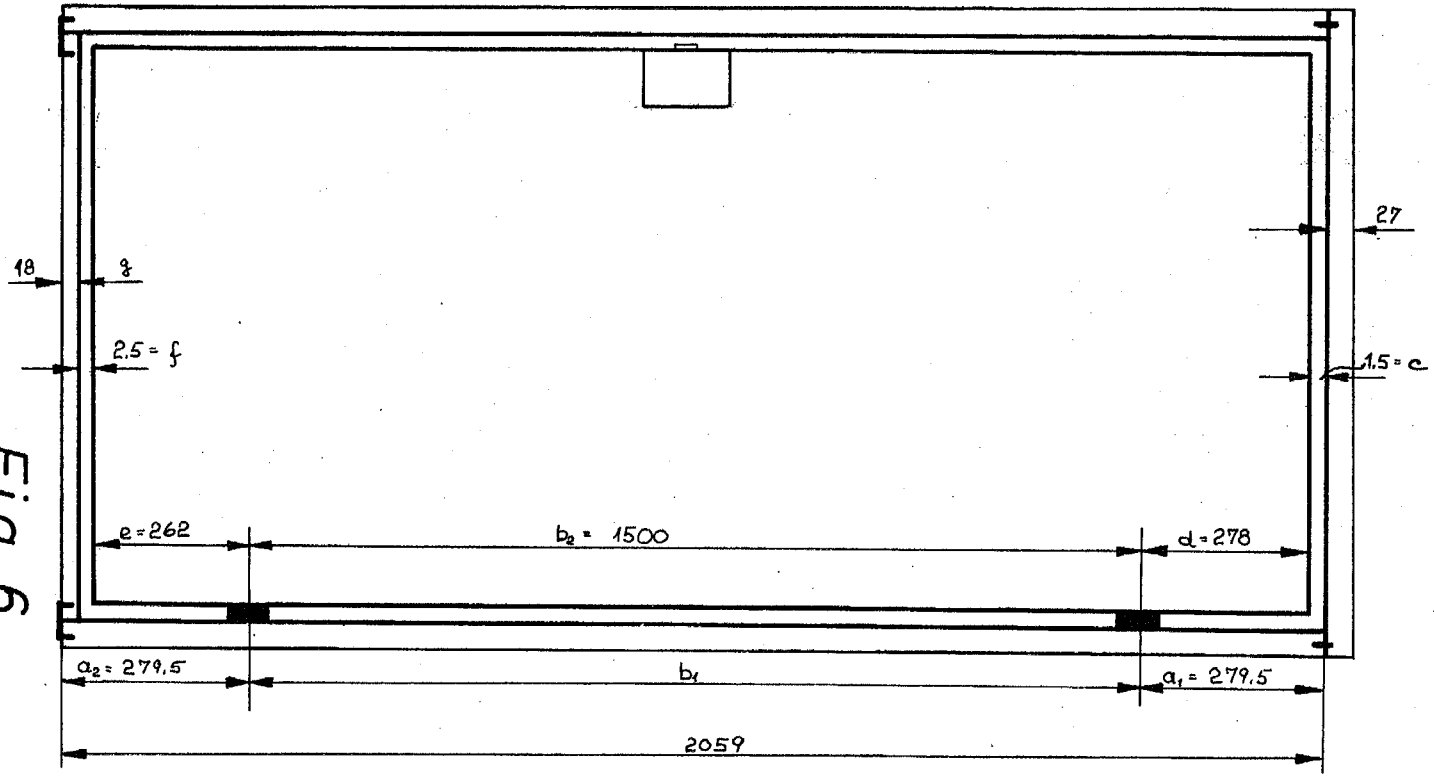

FIG. 2 shows an assembly, which is part of the door set, on an increased scale and seen from above, FIG. 3 shows the same assembly seen from the side, FIG. 4 shows a sectional view of the joint between the sill and the lower end of a side jamb, illustrating how the assembly is placed, FIG. 5 shows a dimensioned sketch illustrating how the door set can be assembled to be a left-hinged door, and FIG. 6 shows a dimensioned sketch similarly illustrating how the door set can be assembled to be a right-hinged door.

FIG. 1 shows a door 1 which, by means of insertion hinges 2 and 3, are hung on a side jamb 4. When, as shown, the door is seen from the hinge side, and the hinges are at the right side, the door is called a right-hinged door. The door set includes another side jamb 5 and a head 6 which is designed so that it can be connected with the side jambs 4 and 5 by means of dowel joints. Furthermore, the door set may include a sill 7, as shown, and the connection between the sill 7 and the side jambs 4 and 5 are established by means of special assemblies 8 and 9 which are identical.

FIGS. 2 and 3 show such an assembly which consists of a supporting plate 10 which is made of plastic material and which is provided with projecting dowels 11, 12, 13, 14, 15 and 16, of which the dowels 11, 12 and 13 are longer than the others.

FIG. 4 shows, together with FIG. 1, how the assembly 8 is placed. The sill 7 is designed with a recess 17 at the bottom of the left side. This recess has the height p calculated from the base of the sill. The supporting plate 10 has the same height p, and the long dowels 11, 12 and 13 are fitted into the corresponding holes 18 at the bottom of the side jamb 5. It should be noted that the top of the side jamb 5 is provided with drillings designed as the drillings at the bottom. In the same way, the ends of the side jamb 4 are provided with identical drillings. Also the sill 7 has holes 19 which accept the shorter dowels 14, 15 and 16.

FIG. 5 shows a dimensioned sketch of a left-hinged door according to this invention. The individual measures are further defined by a letter, so that $a_1$ = the distance from the middle of one hinge to one end of the side jamb, $a_2$ = the distance from the middle of the other hinge to the other end of the side jamb, $b_1$ = the distance between the middle of one hinge and the middle of the other hinge, c = the clearance between the head and the top of the door, d = the distance between the top of the door and the middle of the upper hinge, $b_2$ = the distance between the middle of one hinge and the middle of the other hinge, e = the distance between the middle of the lower hinge and the bottom of the door, f = the clearance between the bottom of the door and the top of the sill, g = the height of the sill, with $g \geqq O$, p = the height of the recess = the height of the supporting plate.

The shown dimensions make it possible to assemble the parts as a right-hinged door instead, such as shown in FIG. 6. In order to do this, the door must be turned 180° along the longitudinal axis, and moreover it will be necessary to move the left side jamb (the jamb with the hinges) in FIG. 5 to the right side as shown in FIG. 6, at the same time turning it upside down. In the same way, the other side jamb should be turned and moved.

It now appears from FIG. 5 that $$a_1 = a_2$$
$$a_1 = e + f + g - p$$

and that $$a_2 = c + d$$

If $a_1$ is not equal to $a_2$, the clearance will not be the same in the two cases. If $a_1$ differs only slightly from $a_2$ it will still be possible to achieve an applicable construction. The present invention should thus allow for the possibility that $a_1$ is different from $a_2$.

If a door construction without a sill is required, the constructions with the dimensions indicated in FIGS. 5 and 6 can be used. Naturally, it will be possible also in this case to change the clearance at the bottom according to requirements, just as an adjustment may be made in case the floor is sloping. It should be emphasized that the height of the head is without importance in relation to this invention just as the height of the sill is optional.

I claim:

1. A reversible door set assembly, comprising:

a door having upper and lower hinge mounting portions on one vertical edge thereof, with a distance d between the center of said upper portion and the top of the door and a distance e between the center of said lower portion and the bottom of the door;

first and second vertical side jamb members, said first member having two spaced hinge mounting areas on one vertical surface thereof, with a distance $a_1$ between the center of one of said areas and the adjacent first end of the jamb and a distance $a_2$ between the center of the other of said areas and the adjacent second end of the jamb opposite said first end thereof;

a horizontal sill member comprising a sill plate extending between said jamb members and having a height g and a bottom recess of height p for receiving a horizontal supporting plate, with a desired clearance f between the bottom of said door and the top of said sill;

a horizontal head member extending between said jamb members with a desired clearance c between the top of said door and the bottom of said head member;

wherein $a_1$ is approximately equal to $a_2$, d and e are both less than the smaller dimension of $a_1$ and $a_2$, and $c+d=e+f+g-p$;

dowel joint means for connecting said sill and head members to said side jamb members, said means comprising dowels extending from said sill and head members and corresponding dowel holes in said side jamb members; and insertion hinge means connecting said door member and said side jamb members, and reversible lock means mounted on said door member, to permit said door set to be changed from a left-hinged door to a right-hinged door without remounting said hinge means, by inverting said first jamb member and rotating said door through a 180° angle about a vertical axis. /

* * * * *